United States Patent [19]

Bury

[11] Patent Number: 4,534,667

[45] Date of Patent: Aug. 13, 1985

[54] DRIVE MECHANISMS FOR INKED RIBBON CASSETTES

[75] Inventor: John E. Bury, Eltham, England

[73] Assignee: Grafton Limited, London, England

[21] Appl. No.: 540,730

[22] Filed: Oct. 11, 1983

[30] Foreign Application Priority Data

Oct. 13, 1982 [GB] United Kingdom ..... 8229194
Jan. 17, 1983 [GB] United Kingdom ..... 8301159

[51] Int. Cl.[3] ..... B41J 35/28; B41J 33/28
[52] U.S. Cl. ..... 400/207; 400/196.1
[58] Field of Search ..... 400/194, 207, 208, 208.1, 400/196, 196.1

[56] References Cited

U.S. PATENT DOCUMENTS

| | | | |
|---|---|---|---|
| 3,830,351 | 8/1974 | Cappotto | 400/208 |
| 3,897,866 | 8/1975 | Mueller | 400/208 |
| 3,974,906 | 8/1976 | Lee et al. | 400/208 X |
| 3,980,171 | 9/1976 | Frechette | 400/208 |

OTHER PUBLICATIONS

IBM Tech. Disc. Bulletin, Hosie et al., "Packaging for Printer Ribbon Cartridges", vol. 24, No. 5, Oct. 1981, pp. 2518-2519.

IBM Tech. Disc. Bulletin, Bergacs et al., "Stuffer Gear Drive," vol. 25, No. 10, Mar. 1983, pp. 5085-5086.

*Primary Examiner*—Edgar S. Burr
*Assistant Examiner*—James R. McDaniel
*Attorney, Agent, or Firm*—Pollock, Vande Sande and Priddy

[57] ABSTRACT

In a stuffed inked ribbon cassette in which ribbon in convoluted form in a stuffing chamber is withdrawn under tension from an outlet and returns along an inlet after passage past a printer, it has been found that a drive wheel having a ratchet tooth form gives surprisingly effective traction on the ribbon. The drive wheel may be used with an idler wheel having a ratchet tooth form or in another embodiment there may also be a simple opposed spring, the ribbon passing between the drive wheel and the idler wheel.

3 Claims, 5 Drawing Figures

DRIVE MECHANISMS FOR INKED RIBBON CASSETTES

FIELD OF THE INVENTION

The present invention relates to stuffed inked ribbon cassettes having improved drive mechanisms.

Typewriters and printers of the dot matrix or daisy wheel type now commonly employ inked ribbon stuffed into a stuffing chamber and joined to form a closed loop. The ribbon is withdrawn from the stuffing chamber along one guide, travels past the printhead and returns along another guide into the stuffing chamber under the action of a drive mechanism that draws in the ribbon.

BACKGROUND TO THE INVENTION

Such mechanisms have commonly employed a pair of meshing gears of involute tooth form that generally rely upon being tensioned laterally by a spring to improve their grip upon the fabric ribbon and thus ensure the transportation of the ribbon across the printhead. But metal and/or plastic spring devices and the structure or housing to contain them are relatively complex and expensive to manufacture and it is time-consuming and expensive to marshal all the parts for assembly prior to the insertion of the ribbon.

The use of springs can impose a substantial element of stress upon the structure of a cassette which must be compensated for, with friction at the journals putting a substantial torque loading upon the printing mechanism that ultimately draws the ribbon across the face of the printhead and returns it into the chamber. This friction at the gear journals also inhibits high speed loading as heat is generated causing excessive wear at the journals.

It has also been proposed to use a single gear wheel of simple serrated form cooperating with a spring plate, but this arrangement also imposes torque upon the cassette drive.

SUMMARY OF THE INVENTION

It has been found that a pair of gears having teeth of a ratchet form, ie. the drive gear having teeth with a generally radial front face with an inclined rear face and the opposite for the idler gear, gives an exceptionally good grip upon a woven nylon ribbon or other typewriter ribbon fabric without recourse to lateral tensioning.

The invention provides a stuffed inked ribbon cassette comprising a cassette body in which is a continuous loop of inked fabric ribbon that is withdrawn past tensioning means from a stuffing chamber in the body and is returned thereto by a drive mechanism wherein the drive mechanism is in the form of a drive gear having teeth of ratchet form that cooperates with an opposing gear with similar teeth and returns the ribbon into the stuffing chamber. The opposed member may be in the form of a simple pressure plate or it may be in the form of an idler gear between which the ribbon passes, the said gears being simply journalled in the cassette body and having teeth of ratchet form with the drive gear teeth having a generally radial front face and an inclined rear face and the idler gear having a generally radial rear face and an inclined front face, ribbon returning from between said gears into the stuffing chamber.

The stuffed inked ribbon cassette is simple to make, has few separate parts and has the versatility to be filled at high speed yet provide a positive drive at the slowest of operational speeds.

BRIEF DESCRIPTION OF THE DRAWINGS

Embodiments of the invention will now be described by way of example only with reference to the accompanying drawings in which.

DETAILED DESCRIPTION OF PREFERRED EMBODIMENTS

Figure 1:
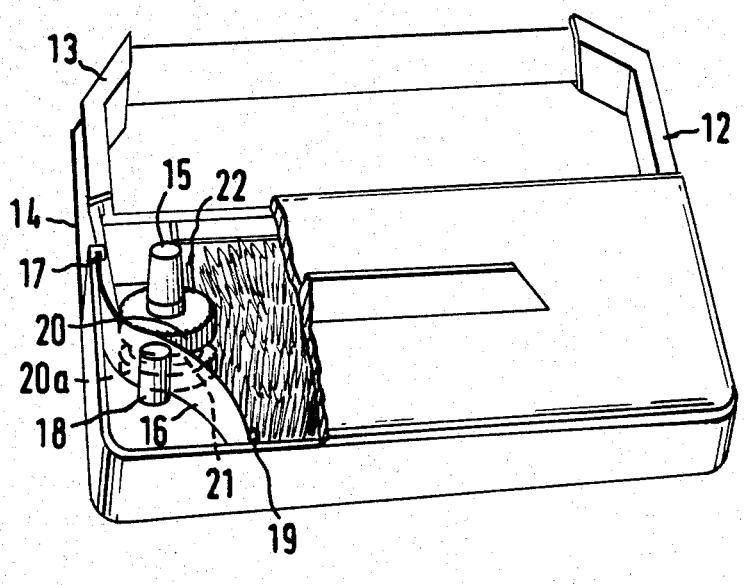
FIG. 1 is a view of a stuffed ribbon cassette for use with a typewriter or printing unit with the lid removed to reveal the use of a simple pressure plate with a drive gear with serrated teeth.
Figure 3:
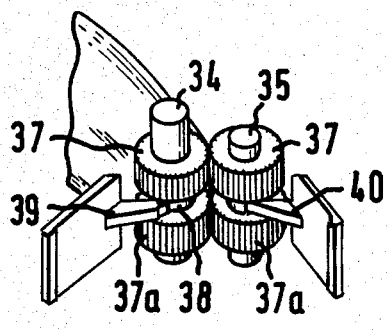
FIG. 3 is an oblique perspective view of the drive and idler wheels with stripping blades in place.
Figure 5:
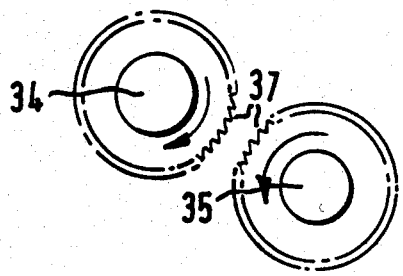
FIG. 5 is a diagram of the drive and idler rollers showing the tooth forms.
Figure 2:
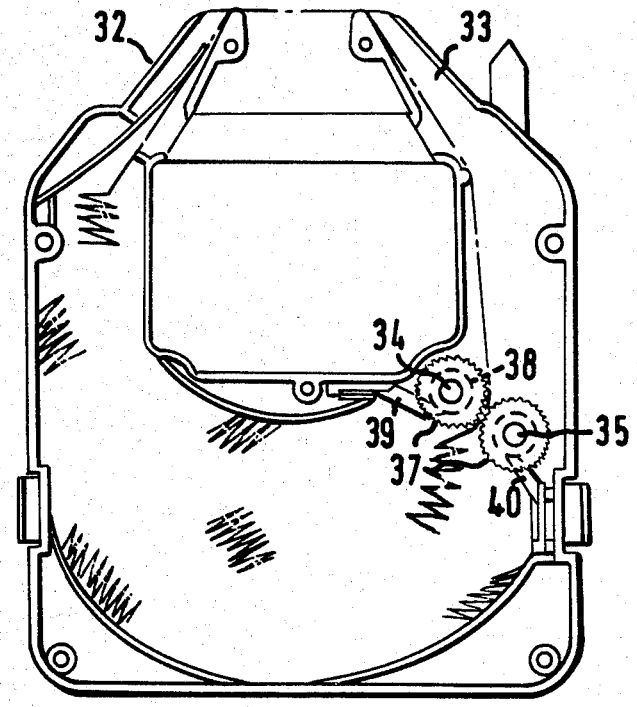
FIG. 2 is a view inside the base of a stuffed ribbon cassette for use with a typewriter or printing unit with the lid removed to reveal the inner structure where meshing teeth are used to transport the ribbon.
Figure 4:
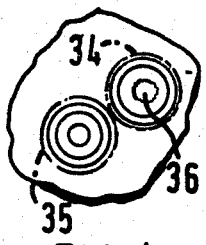
FIG. 4 is an underneath view of the drive and idler wheels journalled in the cassette base.

In FIG. 1 ribbon in convoluted form in a stuffing chamber is withdrawn through an outlet defined between a tensioning spring and a corner post and travels along a right-hand guide arm 12 whence it is guided past the print head (not shown) of the intended typewriter or printer and thence along a left-hand guide arm 13 along which it returns to the stuffing chamber. The tape re-enters the stuffing chamber through a slot 14 and takes a path between drive gear 15 and tensioning spring 16. The tensioning spring is anchored at one end adjacent re-entry slot 14 at anchorage 17, is tensioned by being passed over pin 18 and is anchored at its other end at check block 19. The drive gear 15 is journalled in the base and lid and has a ratchet drive formation by which it can be driven from the typewriter or printer and an inner hexagonal or cruciform formation by which it may be driven when on filling machines during the ribbon filling process. Within the stuffing chamber the gear 15 has upper and lower ribbon-engaging gear elements 20, **20*a* separated by a space 21 for a ribbon guide 22 that ensures that the ribbon strips from gear 15 as it enters the stuffing chamber. The ribbon guide may be manufactured as a separate moulding that slots into a retaining formation in the base and is finally positioned by a rib section depending from the lid as the cassette is closed. The teeth on the circumference of gear elements 20, 20*a* are of ratchet form (ie. they have a generally radial front face and an inclined rear face) and the teeth of elements 20, 20*a* must be in line. It has been found that this ratchet tooth form gives a grip which is superior to that of teeth having the involute form and that sufficient grip can be obtained on a woven ribbon of nylon or other typewriter ribbon fabric with simply an opposed flexed pressure plate taking an arc of the form of the wheel. As a result of using gear elements having ratchet form teeth, the idler gear which is fitted to the majority of current ribbon cassettes can be dispensed with and considerable reduction in the number of separate parts and their assembly time can be gained. The tensioning spring 16 is of spring steel flat section and the pin 18** is so located that the eventual maximum load that can be applied to the ribbon without slipping is approximately 90–110 g but the "loading" on the spring can be varied at will by movement of the pin relative to the wheel center and varying the length of the spring to suit the particular machine drive.

In FIGS. 2 to 5, ribbon in convoluted form in a stuffing chamber is withdrawn through the outlet defined between a tensioning spring and a corner post and travels along a left-hand guide arm 32 whence it is guided past the printhead (not shown) of a typewriter or printer and then along a right-hand guide arm 33 along which it returns to the stuffing chamber. The tape reenters the stuffing chamber between a pair of intermeshing gears 34 and 35. The drive gear 34 is journalled in the base and lid by means of stub shafts at its upper and lower ends and has on its lower end a splined or otherwise formed recess 36 by which it can be driven from the typewriter or printer or, when on filling machines, during the ribbon filling process. The idler gear 35 also has stub shafts at its upper and lower ends and is also simply journalled in the base and lid of the cassette. Within the stuffing chamber the drive gear 34 has upper and lower ribbon-engaging gear elements 37 and 37*a* between which is defined a space 38 for a ribbon stripping blade or guide 39 that ensures that the ribbon strips from gear 34 as it enters the stuffing chamber. The stripper blades may be moulded as part of the cassette or may be manufactured as a separate moulding that slots into a retaining formation in the base and is finally positioned by a rib section depending from the lid as the cassette is closed. The teeth on the circumference of gear elements 37, 37*a* are of ratchet form (ie. they have a generally radial front face and an inclined rear face) and the teeth of element 37, 37*a* must be in line. They mate with corresponding ratchet toothed gear elements 37, 37*a* on idler gear 35 which is also journalled in the base and lid at an appropriate spacing from the drive gear 34 to allow the ribbon to pass between. A second ribbon guide 40 strips ribbon from idler gear 35 and is a sliding fit into another retaining formation in the base. As apparent from FIG. 5 the teeth on the drive gear 34 have generally radial front faces and inclined rear faces (with reference to the direction of rotation) and those on the idler gear 35 have generally radial rear faces and inclined front faces. The ribbon is engaged between the generally radial faces of the drive and idler gears as said gears rotate, and return from between said gears to the stuffing chamber.

It will be appreciated that various modifications may be made to the embodiments described without departing from the invention the scope of which is defined by the appended claims. For example on the gears 34, 35 there could be three gear elements separated by two spaces in which a double ribbon stripping blade runs. Equally the drive gear 34 can be handed to the left or the right with rotation and/or choice of driver to suit the printer.

I claim:

1. A stuffed inked ribbon cassette comprising a cassette body having a continuous loop of inked fabric ribbon thereon that is withdrawn past tensioning means from a stuffing chamber in the body and is returned to said stuffing chamber by a ribbon drive mechanism, said drive mechanism comprising a drive gear and an idler gear which are in gripping engagement with a portion of said ribbon and between which the ribbon passes, the said drive and idler gears each being journalled at fixed centers in the cassette body, and each of said gears having teeth of ratchet form with each of the drive gear teeth having a generally radial front face and an inclined rear face and each of the idler gear teeth having a generally radial rear face and an inclined front face, said ribbon being engaged between said generally radial faces of said drive and idler gears and returned to the stuffing chamber.

2. A cassette according to claim 1, wherein each gear comprises at least two coaxial, axially spaced gear elements which define a space therebetween, and a blade element which travels in said space to ensure stripping of ribbon from the gears prior to entering the stuffing chamber.

3. A cassette according to claim 2, wherein the blade element is a separate component that fits in a retaining formation in a base portion of the cassette body and is firmly located in said formation by the lid portion of the body.

* * * * *